United States Patent [19]

Stahle et al.

[11] 3,997,812

[45] Dec. 14, 1976

[54] DIGITIZING MATRIX FOR ELECTRON BEAMS

[75] Inventors: John F. Stahle, Baltimore; Raymond E. Huber, Westminster, both of Md.

[73] Assignee: Westinghouse Electric Corporation, Pittsburgh, Pa.

[22] Filed: Jan. 29, 1975

[21] Appl. No.: 545,236

[52] U.S. Cl. ..... 313/458; 313/393; 313/395

[51] Int. Cl.[2] ..... H01J 29/10; H01J 29/02

[58] Field of Search ..... 313/393, 395, 414, 410, 313/411, 460, 458, 105 CM

[56] References Cited

UNITED STATES PATENTS

| | | | |
|---|---|---|---|
| 3,408,532 | 10/1968 | Hultberg et al. | 313/105 CM |
| 3,458,745 | 7/1969 | Shoulders | 313/105 CM |
| 3,612,944 | 10/1971 | Requa et al. | 313/105 CM X |

*Primary Examiner*—Robert Segal
*Attorney, Agent, or Firm*—R. M. Trepp

[57] ABSTRACT

A digitizing matrix for electron beams of the type wherein electrons are permitted to pass through openings in the matrix to a target which is scanned with an electron beam. The target is formed from a series of stacked electrode units each formed by electrically-conductive layers extending perpendicular to each other and through which the aforesaid openings pass. By establishing an electrical potential between crossed conductive layers, an electric field will be generated in the area defined by the crossed conductors to stop passage of electrons through one or more of the openings in the aforesaid area. The invention is characterized in that the stacked electrodes are formed as a single unit by thick film techniques wherein successive layers of a dielectric and crossed conductive layers are formed. The assembly facilitates the fabrication of very thin, high electron efficiency, low capacity and low cost flat panel matrices.

7 Claims, 4 Drawing Figures

DIGITIZING MATRIX FOR ELECTRON BEAMS

BACKGROUND OF THE INVENTION

As is known, digitally addressed scan converters have been devised in the past for converting digital information stored in a computer, for example, into a video signal which can be displayed on a television receiving tube or used for other purposes. Such converters comprise a digitizing matrix which is flooded on one side with electrons. On the other side of the matrix is an electron target which can be scanned with an electron beam in the same way as the target of a vidicon tube. The digitizing matrix has a series of laser-drilled holes extending therethrough, the arrangement being such that when electrons from a flooding electron source on one side of the matrix pass through a laser-drilled hole, they will form one point of a scene on the target which can then be scanned with the electron beam.

In order to control the passage of electrons through the holes in the matrix and thus define a particular "picture" or scene on the target, it has been common to divide the matrix into a plurality of electrode units separated by air gaps, each unit comprising a layer of dielectric material having strips of conductive material thereon. The first electrode unit, for example, might have two spaced strips, the strips being perpendicular to those on the next succeeding unit. By applying digital signals to selected ones of the crossed strips on successive electrode units, electric fields can be generated in one or more quadrants of the matrix which will stop passage of electrons through laser holes drilled through that quadrant. The next two electrode units are the same as the first two except that each has four or $2^2$ crossed strips on a surface of a dielectric layer. The third pair of electrode units has $2^3$ strips deposited on spaced dielectric layers, and so on until, for a matrix having $2^n \times 2^n$ holes therein, $2^n$ crossed strips will be on opposite sides of the last electrode unit in the matrix; although in certain cases this number may be decreased by multiplexing techniques.

For example, to address a 512 × 512 element array, at least six electrode units are required. This requires laser drilling of 262,144 holes in each of the units, meaning that 160 hours of drilling time are required on the laser drill. The laser-drilled holes are about 0.001 inch in diameter on 0.003 centers; and the holes in the separated electrode units must be preferably aligned and remain in perfect alignment during the heating and cooling of the electron tube in which they are positioned during processing.

A disadvantage of the prior art system described above is that the dielectric used cannot be sufficiently thick, due to the large differential thermal expansions of silicon dioxide and silicon, causing spalling of the oxide. This results in the electrode units having a capacitance value which is too high to drive at a 10-megahertz rate without using pulses of approximately 100 amperes. Another disadvantage of the prior art system is that the assembly of the electrode units into a stack results in a stack which is approximately 2 inches thick. This results in a minimum tube thickness of about 3.5 to 4 inches.

SUMMARY OF THE INVENTION

In accordance wih the present invention, a new and improved digitizing matrix is provided which overcomes the above and other disadvantages of prior art devices. The matrix of the invention, in contrast to prior art matrices, is a single integral structure formed by silk-screen, thick film techniques. The matrix of the invention has a total thickness of only about 0.015 to 0.020 inch instead of 2 inches as in prior art devices. Furthermore, it facilitates lower capacitance between electrodes, resulting in lower pulse driving requirements, assures perfect hole alignment via laser drilling and results in greater electron efficiencies. Other advantages are lower fabrication costs, the capability of large array fabrication, on the order of 8 to 10 inches square, and tubes of reduced thickness, meaning lower weight and smaller space requirements.

Specifically, in accordance with the invention, there is provided a single unitary structure comprising successive layers of dielectric material and, in-between the successive layers of dielectric material, crossed conductors through which holes are drilled by a laser beam, the crossed conductors forming the aforesaid electrode units. Both the dielectric material and the crossed conductors are preferably formed by silk-screening techniques.

The above and other objects and features of the invention will become apparent from the following detailed description taken in connection with the accompanying drawings which form a part of this specification, and in which.

Figure 1:
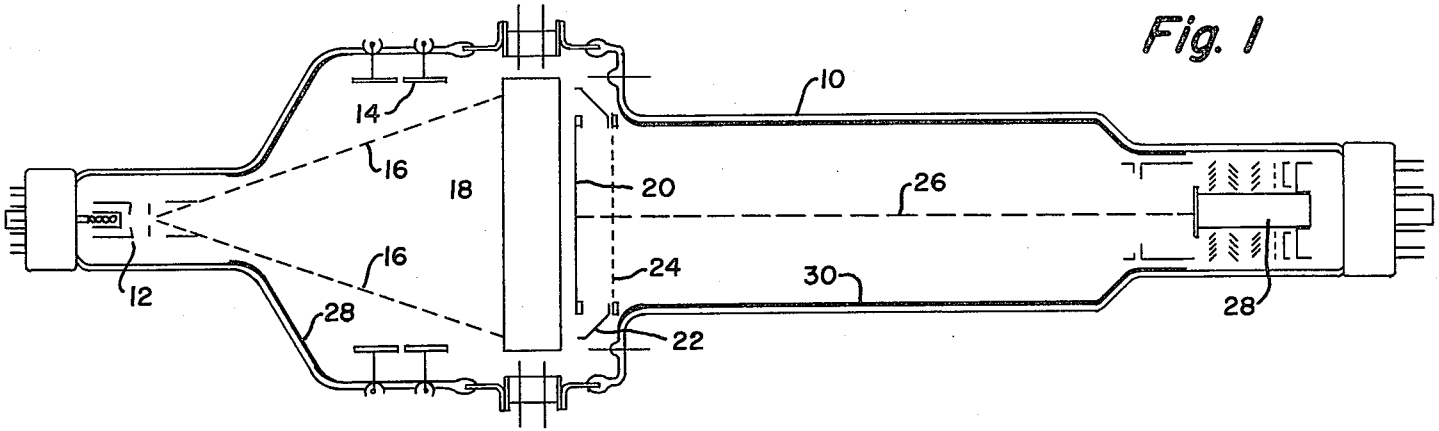
FIG. 1 is a schematic diagram of a binary addressable, scan converter storage tube of the type with which the present invention may be utilized.

With reference now to the drawings, and particularly to FIG. 1, the digitally addressed scan converter storage tube shown includes an outer envelope 10 provided at one end with a flooding electron gun 12 having a collimating lens arrangement 14. The electron gun 12 and its associated collimating lens are such as to produce a flood of electrons which spread outwardly as indicated by the broken lines 16 onto a digitizing matrix and collector 18 which forms the subject of the present invention. On the side of the digitizing matrix 18 opposite the electron gun 12 is a target 20 provided with a decelerator 22 and a field mesh 24. Directed onto the target 20 is an electron beam 26 emanating from an electron gun 28. Means, not shown, are provided for causing the electron beam 26 to scan the target 20 in a manner similar to that of a vidicon. Metallic wall coatings 28 and 30 are provided on the inner surfaces of the tube on opposite sides of the digitizer 18. Binary signals are applied to the digitizer, in a manner hereinafter described, from a computer or the like.

Figure 2:
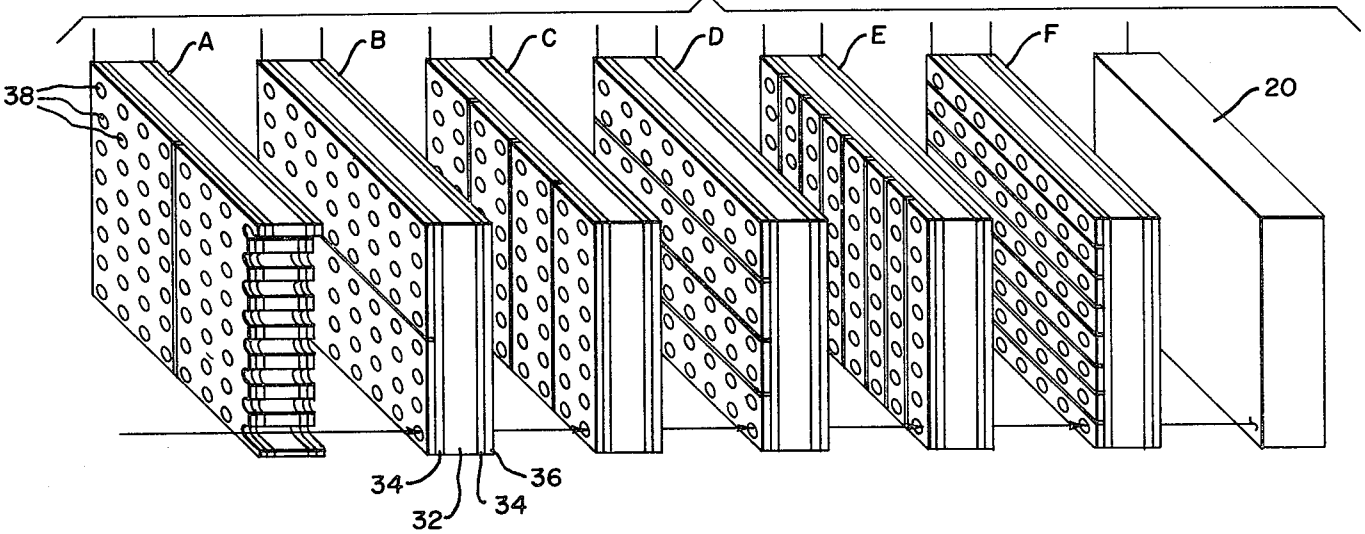
Fig. 2 Prior Art
FIG. 2 illustrates a prior art digitizer assembly incorporated herein for purposes of explanation.

A prior art digitizer and target assembly is shown in FIG. 2. It comprises six plates or electrode units identified as A–F. Each plate comprises a silicon substrate 32 having layers of silicon dioxide 34 on opposite sides thereof. On one side of each electrode unit is a continuous metallic film 36; whereas the other side (i.e., that side which can be viewed in FIG. 2), is divided into strips or columns, the columns in successive units being at right angles to each other. Drilled through the six electrode units A–F are aligned openings or holes 38, a typical number of holes for a 512 by 512 element array being 262,144. Obviously, only a portion of the array is shown in FIG. 2 and is greatly enlarged.

It will be noted that there are two strips on the first two units A and B, four strips on units C and D and eight on units E and F. The crossover of the strips on units E and F defines the area encompassed by one hole 38, these holes typically being about 0.001 inch in diameter on 0.003 inch centers. By applying appropriate potentials to the strips on the units, electric fields can be generated which will block the passage of electrons therethrough. Thus, by proper application of potentials to the strips on units A and B, one-half or one quadrant of the scene can be blocked out. Further, by selective energization of the electrodes C through F, electrons can be blocked through any one set of aligned holes. The films 36 are all connected to a source of positive potential to bleed away any electrons which become trapped in the silicon or silicon dioxide.

The target 20 may take various forms but in the preferred embodiment comprises metal plugs extending through a metal oxide membrane with a coplanar mesh grid formed by evaporation between the plugs. The storage elements are operated negatively with respect to the mesh to modulate the collection of reading beam electrons by the mesh and, therefore, modulate the current being returned to the mesh 24.

As was explained above, the prior art electrode assembly of FIG. 2 is deficient in that it has a relatively large thickness on the order of 2 inches; and the alignment of the laser-drilled holes in the respective electrode units is highly critical. Furthermore, the silicon dioxide used cannot be sufficiently thick due to the large differential thermal expansion of silicon dioxide and silicon, causing spalling of the oxide which results in the electrode having a capacitance which is too high to drive at a 10-megahertz rate without using pulses of approximately 100 amperes.

Figure 3:
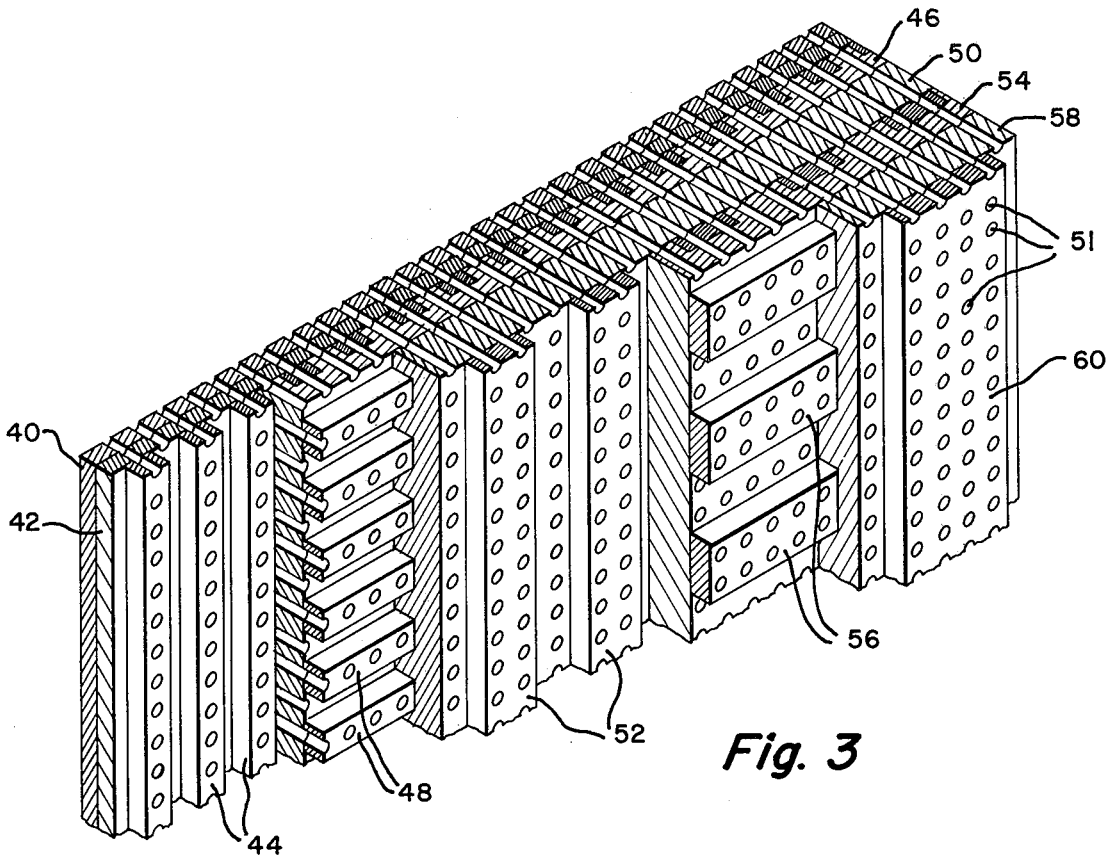
FIG. 3 is a perspective view of the new and improved digitizer matrix of the present invention.
Figure 4:
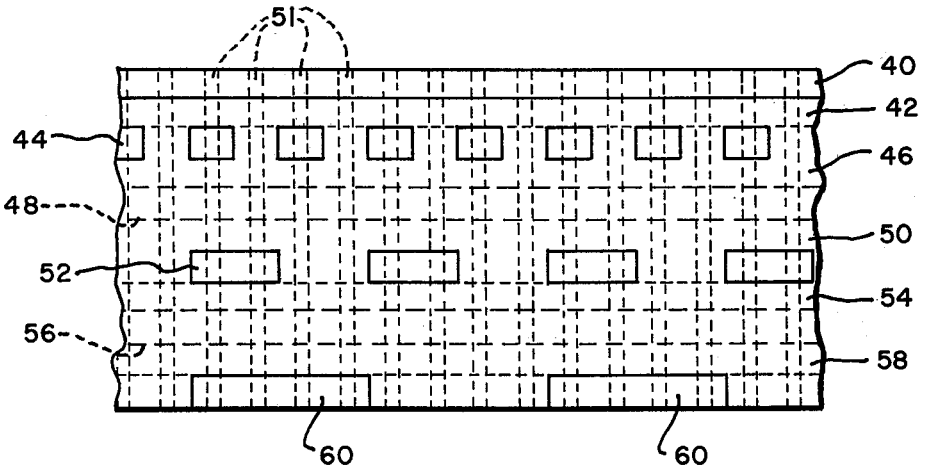
FIG. 4 is a top view of the matrix of FIG. 3.

In the present invention, these difficulties are eliminated with the arrangement shown in FIGS. 3 and 4. The assembly shown includes a molybdenum or aluminum plate 40 onto which is applied, by silk-screening techniques, a first layer of aluminum oxide or some other suitable dielectric material. The first layer is identified by the reference numeral 42 and has a thickness of about 0.5 to 1 mil. Deposited over the first layer 42, also by silk-screening techniques, are chromium-gold or nickel-gold strip electrodes 44. Over the first strip electrodes 44 is deposited a second dielectric layer 46, followed by deposition of strip electrodes 48 which are the same widths as the electrodes 44 but at right angles thereto. The crossover areas of the electrodes 44 and 48 define an area slightly larger than the size of a loose-drilled hole 51 passing through the unit. Over the strip electrodes 48 is deposited a third dielectric layer 50, followed by deposition of vertical electrodes 52 which are equal in number to half the number of electrodes 44 and 48 and twice the width. Following deposition of electrodes 52, a fourth dielectric layer 54 is applied, followed by description of electrodes 56 which are the same size as electrodes 52 but at right angles thereto. Another dielectric layer 58 is applied followed by application of vertical electrodes 60 which are equal to half the number of electrodes 52 and 56 but twice the width. Finally, another dielectric layer, not shown, will be applied together with an electrode, corresponding to electrodes 60, at right angles thereto.

It can be seen that the structures of FIGS. 3 and 4 is much simpler than that of FIG. 2, the total thickness of the device being only about 0.015 inch to 0.020 inch instead of 2 inches. Since the ceramic dielectric utilized can be very thick, this reduces the electrode capacitances. In this respect, while the prior art system shown in FIG. 2 has a dielectric that is less than 0.0001 inch thick, the ceramic dielectric layers of the assembly of FIGS. 3 and 4 can be approximately 0.001 inch thick and possibly thicker. This reduces the electrode capacitance from 6000 pf to less than 600 pf and greatly reduces the driving pulse requirements.

The assembly of FIGS. 3 and 4 is built up and laser drilled. Since it is an integral assembly, the holes 51 between electrode plates will automatically have perfect registry and cannot be misaligned as in the prior art device. This improves the electron optics of each hole and increases the electron efficiency of each hole. Furthermore, individual electrodes for each unit, such as electrodes 36 in FIG. 2, can be eliminated. The molybdenum plate 40 can be removed from the completed assembly or retained and used for a purpose similar to that of electrodes 36 in FIG. 2.

Although the invention has been shown in connection with a certain specific embodiment, it will be readily apparent to those skilled in the art that various changes in form and arrangement of parts may be made to suit requirements without departing from the spirit and scope of the invention.

What is claimed is:

1. In a digitizing matrix for electron beams of the type wherein electrons are permitted to pass through openings in the matrix to a target which is scanned with an electron beam and wherein the matrix comprises a series of stacked electrode units each formed by electrically-conductive layers extending transverse to each other and through which said openings pass; the improvement in said digitizing matrix of a low capacity single unitary structure including successive layers of thick dielectric material wherein each layer of dielectric material is in the neighborhood of 0.5 to 1 mil thick, and in-between the successive layers of the dielectric material, crossed conductors forming a plurality of crossover areas, each of said crossover areas having a predetermined combination of crossed conductors for decoding said plurality of crossover areas, each of said crossover areas having at least one opening, whereby selected crossover areas permit electrons to pass therethrough and wherein said unitary structure is in the neighborhood of 0.015 to 0.020 inches thick.

2. The improvement of claim 1 wherein the successive layers of dielectric material comprise silk-screened layers of a refractory oxide.

3. The improvement of claim 2 wherein said crossed conductors are formed on successive ones of said layers of refractory material by silk-screening.

4. The improvement of claim 2 wherein said refractory oxide is aluminum oxide.

5. The improvement of claim 1 wherein the crossed conductors are divided into pairs of coplanar conductors extending transverse to each other, successive parts of conductors being wider than the immediately preceding pair.

6. The improvement of claim 5 wherein said crossed conductors are perpendicular to each other.

7. The improvement of claim 1 wherein said crossover areas define an area slightly larger than the size of said opening.

* * * * *